US006624789B1

(12) United States Patent
Kangasvieri et al.

(10) Patent No.: US 6,624,789 B1
(45) Date of Patent: Sep. 23, 2003

(54) METHOD AND SYSTEM FOR IMPROVING ISOLATION IN RADIO-FREQUENCY ANTENNAS

(75) Inventors: Tomi Kangasvieri, Oulu (FI); Marko E. Leinonen, Oulu (FI)

(73) Assignee: Nokia Corporation, Espoo (FI)

( * ) Notice: Subject to any disclaimer, the term of this patent is extended or adjusted under 35 U.S.C. 154(b) by 20 days.

(21) Appl. No.: 10/121,958

(22) Filed: Apr. 11, 2002

(51) Int. Cl.[7] ..... H01Q 1/24; H01Q 1/52
(52) U.S. Cl. ..... 343/702; 343/841
(58) Field of Search ..... 343/700 MS, 702, 343/841; 455/575.5, 575.7

(56) References Cited

U.S. PATENT DOCUMENTS 2,947,987 A * 8/1960 Dodington ..... 343/841
4,641,366 A * 2/1987 Yokoyama et al. ..... 343/841
4,721,962 A * 1/1988 Gorzel ..... 343/702
4,723,305 A * 2/1988 Phillips et al. ..... 343/702

* cited by examiner

*Primary Examiner*—Michael C. Wimer
(74) *Attorney, Agent, or Firm*—Ware, Fressola, Van Der Sluys & Adolphson LLP

(57) ABSTRACT

In an antenna structure having a transmit antenna disposed over a first section of a ground plane and a receive antenna disposed over a second section of the ground plane, a cut is provided between the first and second sections of the ground plan The length of the cut is substantially equal to one quarter-wavelength of the operating frequency band of transmit/receive antenna pair so as to provide isolation between the transmit antenna and the receive antenna. If the antenna structure also has a transceiver antenna operated in a further frequency band disposed over the same ground plane and straddling over the first section and the second section, a switch is provided over the cut. The switch is operating in a closed position when the transceiver antenna in the further frequency band is used, and in an open position when the transmit/receiver antenna pair is used.

21 Claims, 9 Drawing Sheets

METHOD AND SYSTEM FOR IMPROVING ISOLATION IN RADIO-FREQUENCY ANTENNAS

FIELD OF THE INVENTION

The present invention relates generally to an antenna structure and, more particularly, to an antenna structure for use in a mobile terminal.

BACKGROUND OF THE INVENTION

In PCS band full duplex systems, the duplex separation of receiving and transmitting bands is so small that it sets very stringent requirements for the duplex filters. To meet these requirements, the overall volume of the duplexer is typically very large. Consequently, the losses in the signal path are very high. Moreover, the thickness of a mobile phone equipped with such a duplexer is not easily reduced.

It is advantageous and desirable to provide an antenna structure that does not require a large volume, while the isolation in the antenna can be improved.

SUMMARY OF THE INVENTION

It is a primary object of the present invention to provide an antenna structure having a transmit antenna and a receive antenna, wherein the isolation between the transmit and receive antennas is improved. The object can be achieved by providing a cut in the ground plane for causing the conducted power in the ground plane to undergo a 180-degree phase shift with respect to the radiated power in air. Alternatively, one of the antennas is a planar inverted-F antenna (PIFA) whereas the other is a slot antenna, wherein the signal fed to the slot antenna undergoes a substantially 180-degree phase shift before it is coupled to the ground plane.

According to the first aspect of the present invention, there is provided an antenna structure (1) comprising:

- a ground plane (10) having a first section (12) and a second section (14) galvanically connected to the first section (12); and
- an antenna system (22, 24) operable in a frequency band disposed over the ground plane (10), the antenna system comprising a receive antenna (22) and a transmit antenna (24), wherein
  - the receive antenna (22) comprises a first radiating element (30) disposed over the first section (12) of the ground plane (10), and a first grounding strip (34) for grounding the first radiating element (30) to the first section (12) of the ground plane (10); and
  - the transmit antenna (24) comprises a second radiating element (40) disposed over the second section (14) of the ground plane (10), and a second grounding strip (44) for grounding the second radiating element (40) to the second section (14) of the ground plane (10). The antenna structure is characterized by
- a slot (20) provided between the first section (12) and the second section (14) of the ground plane (10) for improving isolation between the receive antenna and the transmit antenna, wherein the slot has an effect length (L) substantially equal to a quarter wavelength of the frequency band.

According to the present invention, the first section (12) is connected to the second section (14) by a connecting section (16) of the ground plane (10) for realizing the effective length (L). Alternatively, the antenna structure further comprises a switching means (64) over the slot (20) operated in a closed position for realizing the effective length (L).

According to the present invention, the antenna structure further comprises a transceiver antenna (26) operable in a further frequency band different from the frequency band, wherein the transceiver antenna (26) comprises a third radiating element (50) disposed over the ground plane, straddling both the first and second sections of the ground plane, and a third grounding strip (54) for grounding the third radiating element to the ground plane. The antenna structure is characterized by

- a switching means (60) disposed over the slot, wherein the switching means is operable
  - in a closed position, for electrically connecting the first section (12) and the second section (14) when the antenna structure (1) is operating in the further frequency band, and
  - in an open position, for keeping the first section (12) and the second section (14) electrically separated over the slot, when the antenna structure (1) is operating in the frequency band.

According to the present invention, the antenna structure further comprises a further antenna system (122, 124) operable in a third frequency band different from the frequency band, the further antenna system comprising a further receive antenna (122) and a further transmit antenna (124), wherein

- the further receive antenna (122) comprises a fourth radiating element (130) disposed over the first section of the ground plane, and a fourth grounding strip (134) for grounding the fourth radiating element to first section of the ground plane; and
- the further transmit antenna (124) comprises a fifth radiating element (140) disposed over the second section of the ground plane, and a fifth grounding strip (144) for grounding the fifth radiating element to the second section of the ground plane. The antenna structure is characterized in that
  - the switching means (60) is also operating in the open position when the antenna structure is operating in the third frequency band. The antenna structure is further characterized by
    - a further switching means (62, 64) disposed over the slot, wherein the further switching means is operable
      - in a closed position for retaining the effective length (L) of the slot when the antenna structure is operating in the frequency band, and
      - in an open position for realizing an effective length (L') of the slot substantially equal to a quarter wavelength of the third frequency band when the antenna structure is operating in the third frequency band.

Alternatively, the further switching means (64) is operable

- in an open position for retaining the effective length (L) of the slot when the antenna structure is operating in the frequency band, and
- in a closed position for realizing an effective length (L') of the slot substantially equal to a quarter wavelength of the third frequency band when the antenna structure is operating in the third frequency band.

According to the second aspect of the present invention, there is provided a method of improving isolation in an antenna structure (1), wherein the antenna structure (1) comprises:

a ground plane (10) having a first section (12) and a second section (14) galvanically connected (16) to the first section (12), and an antenna system (22, 24) operable in a frequency band disposed over the ground plane (10), the antenna system comprising a receive antenna (22) and a transmit antenna (24), wherein the receive antenna (22) comprises a first radiating element (30) disposed over the first section (12) of the ground plane (10), and a first grounding strip (34) for grounding the first radiating element (30) to the first section of the ground plane (10); and the transmit antenna (24) comprises a second radiating element (40) disposed over the second section (14) of the ground plane (10), and a second grounding strip (44) for grounding the second radiating element (40) to the second section of the ground plane (10). The method is characterized by providing a slot (20) between the first section (12) and the second section (14) of the ground plane for improving isolation between the transmit antenna and the receive antenna, wherein the slot has an effective length (L) substantially equal to a quarter wavelength of the frequency band.

According to the present invention, wherein the antenna structure (1) further comprises a transceiver antenna (26) operable in a further frequency band different from the frequency band, the transceiver antenna (26) comprising a third radiating element (50) disposed over the ground plane, straddling both the first and second sections of the ground plane, and a third grounding strip (54) for grounding the third radiating element to the ground plane. The method is further characterized by providing a switching means (60) over the slot, wherein the switching means is operable in a closed position, for electrically connecting the first section (12) and the second section (14) when the antenna structure (1) is operating in the further frequency band, and in an open position, for keeping the first section (12) and the second section (14) electrically separated over the slot (20), when the antenna structure (1) is operating in the frequency band.

According to the third aspect of the present invention, there is provided by a mobile terminal (200) having an improved antenna structure (1) for receiving and transmitting information in a frequency band, the antenna structure (1) comprising:

a ground plane (10) having a first section (12) and a second section (14) galvanically connected (16) to the first section (12), and an antenna system (22, 24) disposed over the ground plane (10), the antenna system (22, 24) comprising a receive antenna (22) and a transmit antenna (24), wherein the receive antenna (22) comprises a first radiating element (30) disposed over the first section (12) of the ground plane (10), and a first grounding strip (34) for grounding the first radiating element (30) to the first ground plane (10); and the transmit antenna (24) comprises a second radiating element (40) disposed over the second section (14) of the ground plane (10), and a second grounding strip (44) for grounding the second radiating element (40) to the second section of the ground plane (10). The mobile terminal is characterized by a slot (20) provided between the first section (12) and the second section (14) of the ground plane (10) for improving isolation between the receive antenna and the transmit antenna, wherein the slot has an effective length (L) substantially equal to one quarter wavelength of the frequency band.

According to the present invention, wherein the antenna structure (1) further comprises a transceiver antenna (26) operable in a further frequency band different from the frequency band, the transceiver antenna (26) comprising a third radiating (50) element disposed over the ground plane, straddling both the first and second sections of the ground plane, and a third grounding strip (54) for grounding the third radiating element to the ground plane. The mobile terminal is characterized by a switching means (60) disposed over the slot, wherein the switching means is operable in a closed position, for electrically connecting the first section (12) and the second section (14) when the antenna structure is operating in the further frequency band, and in an open position, for keeping the first section (12) and the second section (14) electrically separated over the slot (20), when the antenna structure is operating in the frequency band.

According to the fourth aspect of the present invention, there is provided an antenna structure (2) comprising a first antenna (70, 80) and a second antenna (40), each antenna having a radiating element, a feed line and a grounding strip coupling to the radiating element to a ground plane, wherein one of the first and second antennas is used for transmission and the other is used for reception. The antenna structure (2) is characterized in that the radiating element (78, 88, 90) has a slot (76, 86) provided thereon for effectively separating the feed line (72, 82) and the grounding strip (74, 84) of the first antenna (70, 80) by a distance substantially equal to one half wavelength of a resonant frequency of the radiating element (78, 88, 90) of the first antenna.

Preferably, the slot has a length substantially equal to a quarter-wavelength of the resonant frequency.

Preferably, the first antenna is a slot antenna and the second antenna is a planar inverted-F antenna.

Advantageously, the first antenna (80) is a multiple-band antenna operating in at least a first frequency band and a second frequency band different from the first frequency band, the first antenna further having a further radiating element coupled to the radiating element, and wherein the resonant frequency of the radiating element of the first antenna falls within the first frequency band, and the further radiating element has a resonant frequency within the second frequency band.

Advantageously, the radiating element of the second antenna has a resonant frequency within the first frequency band.

According to the fifth aspect of the present invention, there is provided a method of improving isolation in antenna structure (2), wherein the antenna structure comprises a first antenna (70, 80) and a second antenna (40), each antenna having a radiating element, a feed line and a grounding strip coupling to the radiating element to a ground plane, wherein one of the first and second antennas is used for transmission and the other is used for reception. The method is characterized by providing a slot (76, 86) on the radiating element (78, 88, 90) for effectively separating the feed line (72, 82) and the grounding strip (74, 84) of the first antenna (70, 80) by a distance substantially equal to one half wavelength of a resonant frequency of the radiating element (78, 88, 90) of the first antenna.

Preferably, the slot has a length substantially equal to one quarter-wavelength of the resonant frequency.

The present invention will become apparent by reading the description taken in conjunction with FIGS. 1 to 5*b*.

BEST MODE TO CARRY OUT THE INVENTION

The radiating characteristics of a planar inverted-F antenna (PIFA) depend on the ground plane as well as on the antenna element itself. Using a transmit antenna as an example, the signal power fed to the radiating element of the transmit antenna also appears as current in the ground plane that is used to short-circuit the radiating element. Thus, in an antenna system where separate antennas operating in substantially the same frequency are used for transmission and reception, and wherein the transmit antenna and the receive antenna use a common ground plane for grounding, the power fed to one antenna also appears in another antenna via the ground plane. In that case, the isolation between the transmit antenna and the receive antenna is effectively diminished.

It is a primary object of the present invention to improve the isolation between antennas operating in substantially the same frequency band and disposed over a common ground plane for grounding. To achieve this object, the present invention uses a cut in the common ground plane to change the phase of the conducted power in the ground plane.

Figure 1:
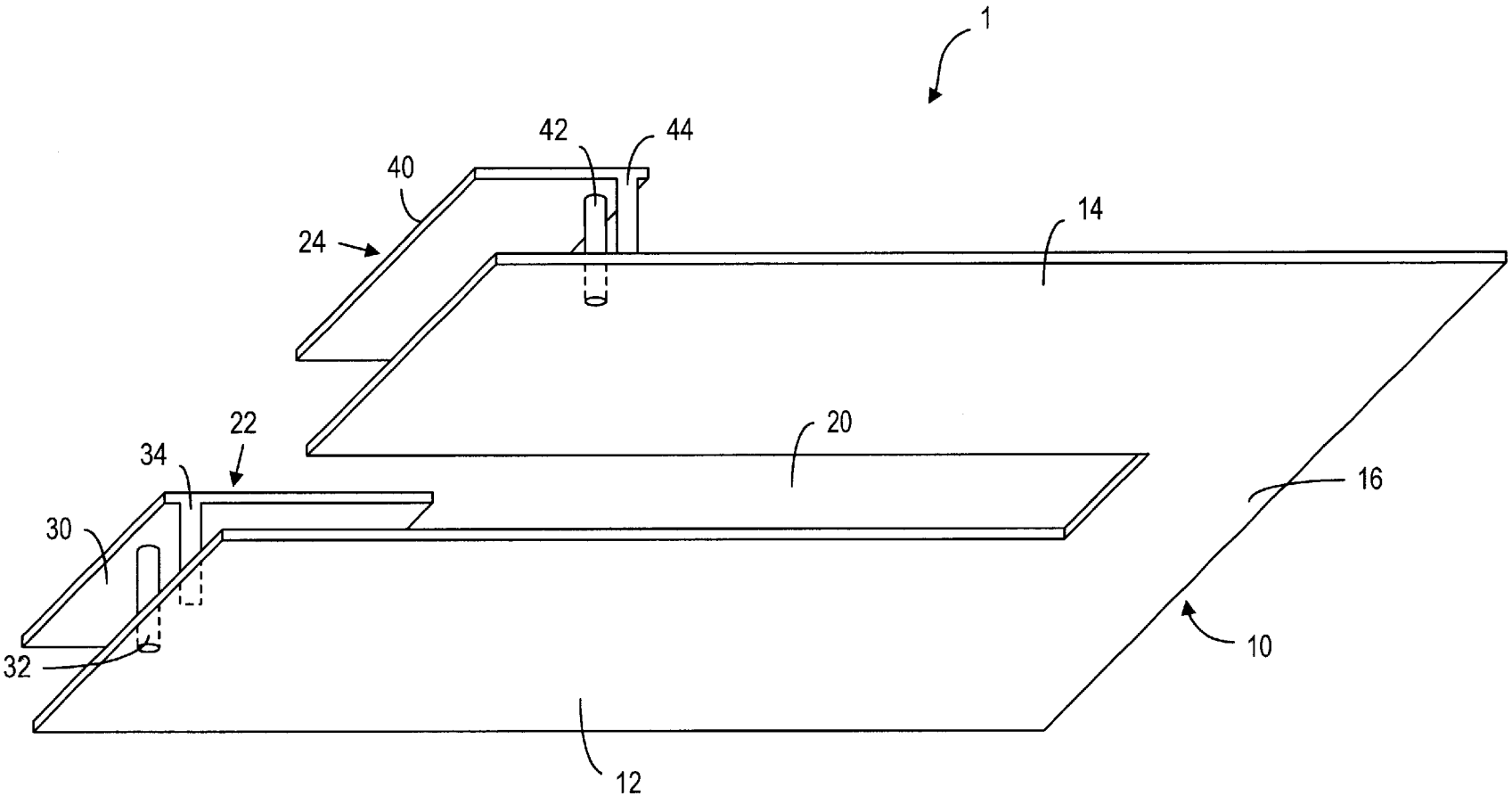
FIG. 1 is an isometric view showing the relationship between the Tx/Rx antenna pair, the ground plane and the slot in the ground plane, according to the present invention.
Figure 2:
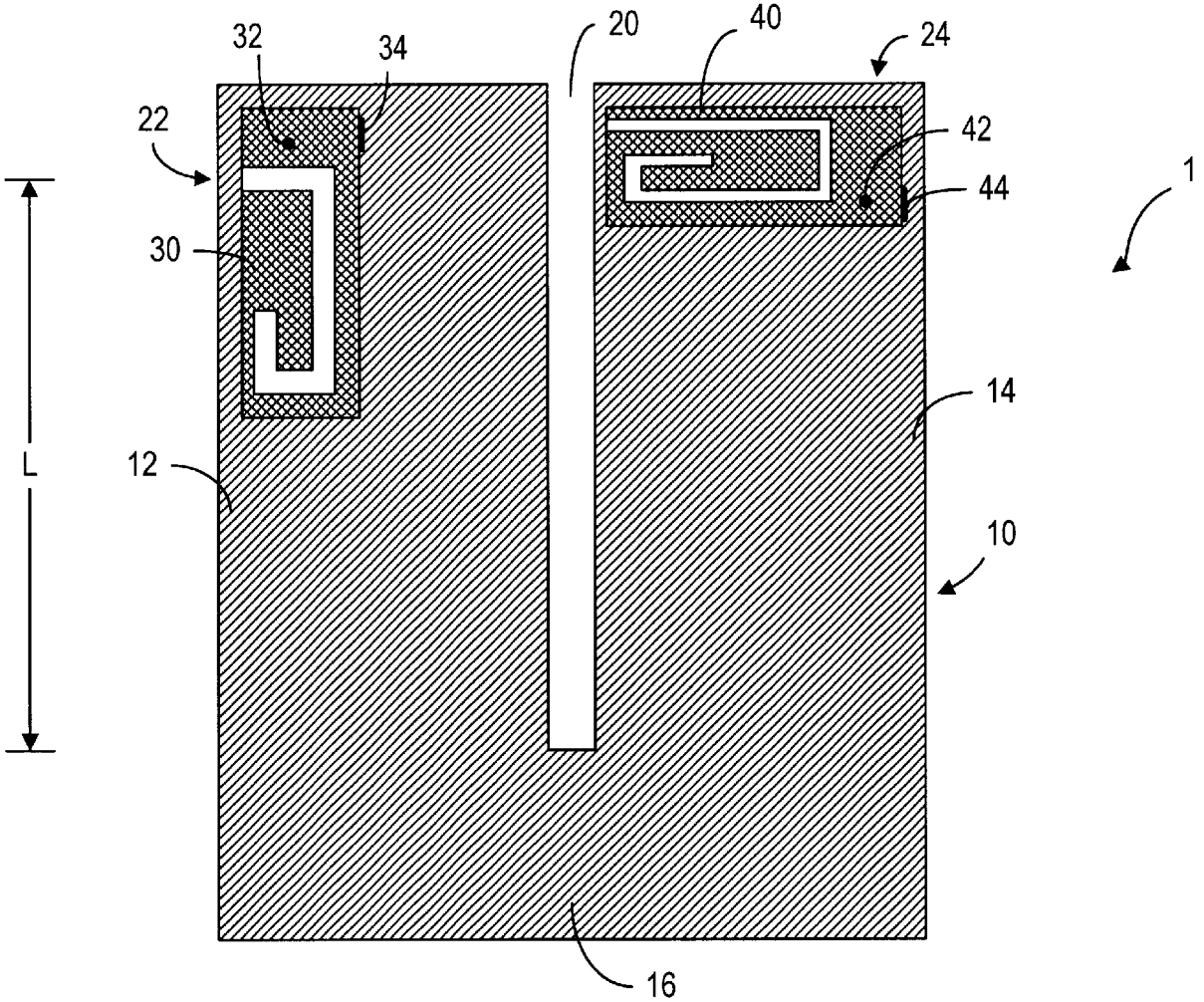
FIG. 2 is a schematic representation showing the top view of the antenna structure of FIG. 1.

As shown in FIG. 1, the antenna structure 1 comprises a ground plane 10, a first antenna 22 and a second antenna 24. The first antenna 22 and the second antenna 24 operate in substantially the same frequency band, so one can be used as a transmit antenna and the other can be used as a receive antenna in a code-division multiple access system. For example, in PCS band, the transmit frequency band is in the range of 1850–1910 MHz, and the receive frequency band is in the range of 1930–1990 MHz. Systems such as CDMA IS-95, GSM-1900 and WCDMA-1900 are operated in this particular frequency band. The first antenna 22 comprises a radiating element 30, a feed line 32, and a grounding strip 34 connecting the radiating element 30 to the ground plane 10 for grounding. The second antenna 24 comprises a radiating element 40, a feed line 42 and a grounding strip 44 connecting the radiating element 40 to the ground plane 10 for grounding. In order to improve the isolation between the first antenna 22 and the second antenna 24, a slot 20 is provided in the ground plane 10 such that the ground plane 10 is separated into a first section 12 and a second section 14, galvanically connected via a connecting section 16. The slot 20 has an effective length L, which is substantially equal to one quarter-wavelength of the center frequency of the radiating elements 30, 40 as shown in FIG. 2. As such, the conducted power in the receive antenna via the ground plane 10 is phase-shifted by 180 degrees as compared to the power radiated in air from the transmit antenna. Consequently, the radiated power and the conducted power compensate each other, and the isolation between the first antenna 22 and the second antenna 24 is improved. It should be noted that the effective length L can be realized by the connecting section 16, as shown in FIG. 2, or by a switch 62, as shown in FIG. 3C.

Figure 3A:
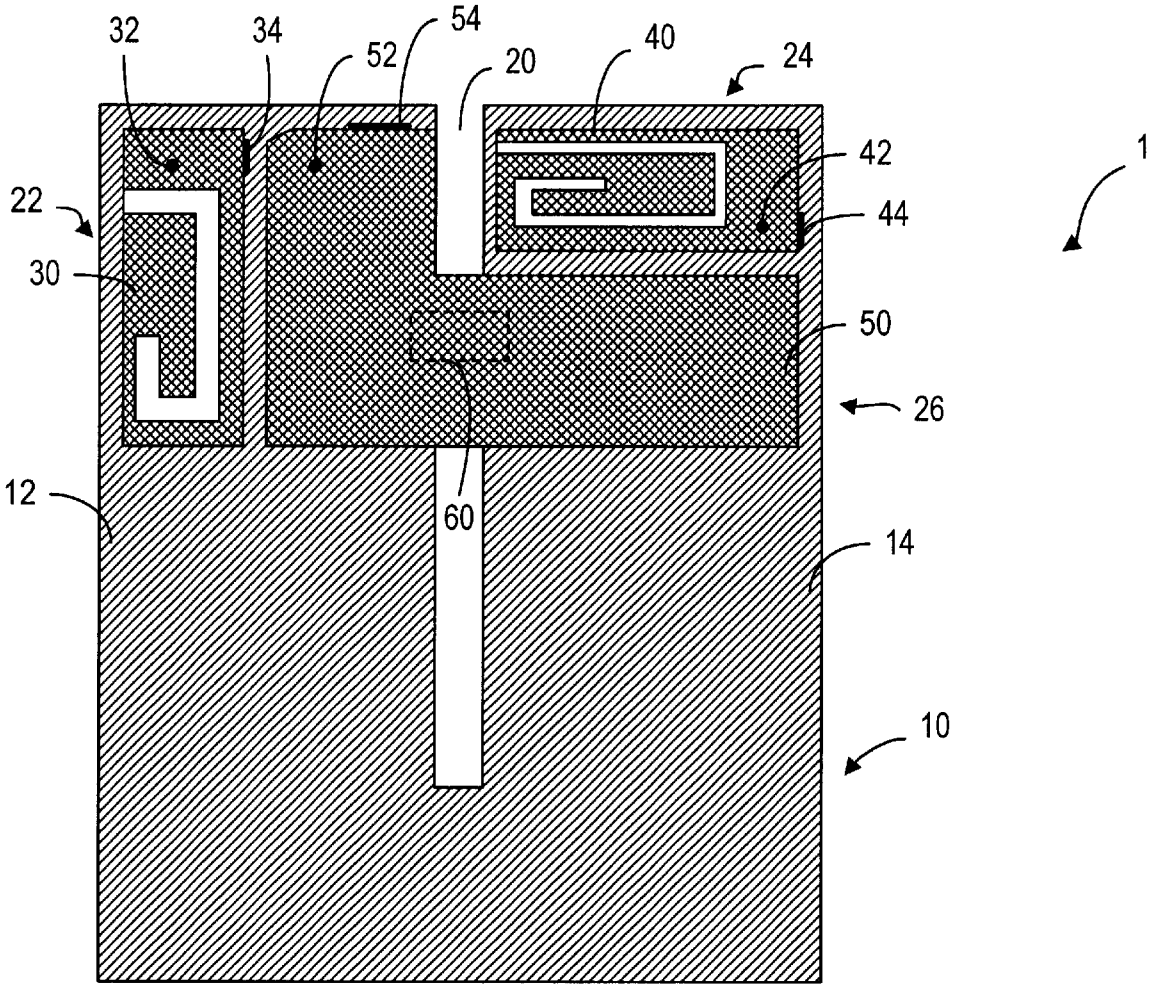
FIG. 3*a* is a schematic representation showing a third antenna disposed over the ground plane.
Figure 3B:
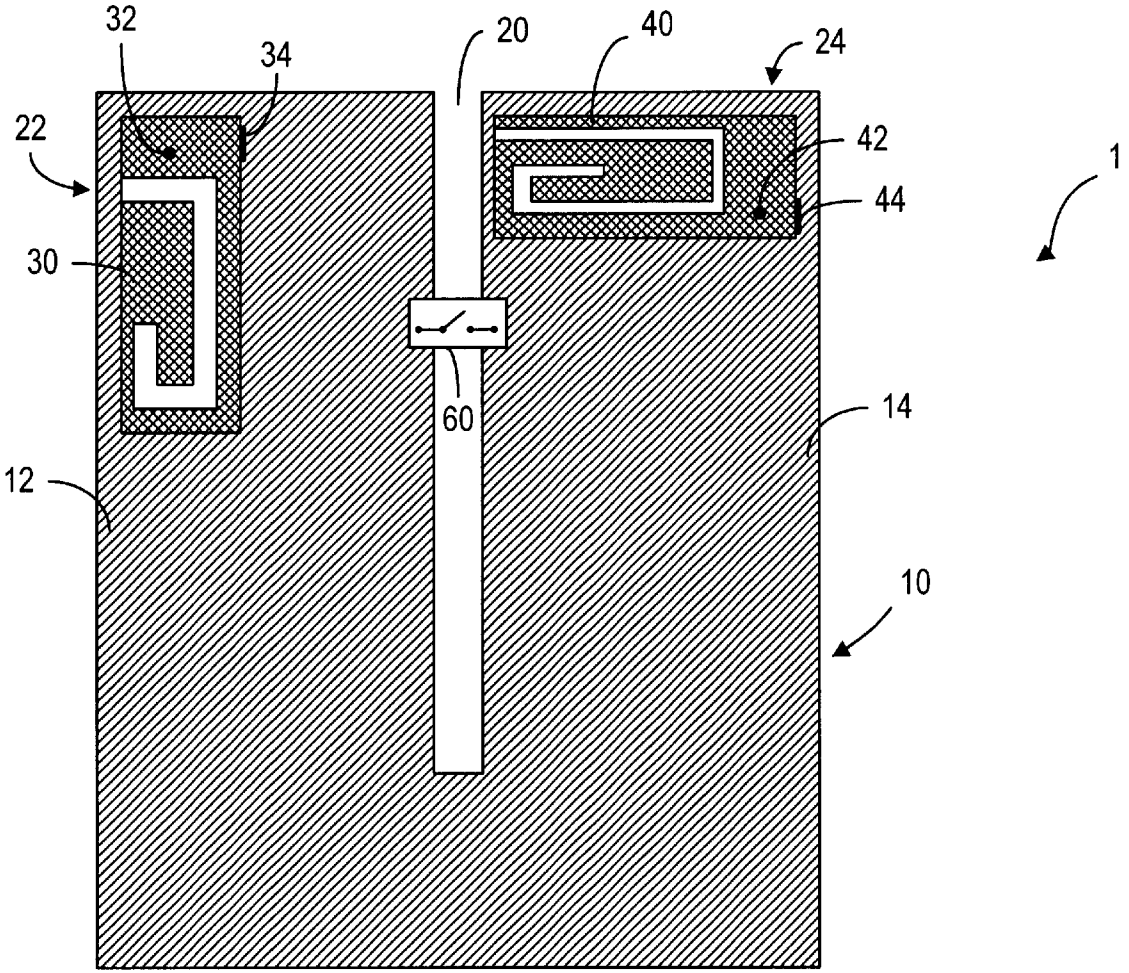
FIG. 3*b* is a schematic representation showing a switch operating in the open position when the Tx/Rx antenna pair is used.

In a multi-band mobile terminal, a GSM antenna operating in the frequency range of 824–894 MHz may be included—systems such as AMPS and GSM 850 are operated in this particular frequency band. Likewise, a GSM antenna operating in the frequency range of 880–960 MHz (in Europe) may also be included. Furthermore, an antenna for use in the DCS 1710–1880 MHz band or in the WCDMA 2000 1920–2170 MHz band can be included. It is possible to use the same ground plane 10 for grounding the GSM antenna. As shown in FIG. 3*a*, a third antenna 26 comprises a radiating element 50, a feed line 52 and a grounding strip 54 connecting the radiating element 50 to the ground plane 10 for grounding. As shown, the radiating element 50, which has a resonant frequency substantially lower than the operating frequency band of the first antenna 22 and the second antenna 24, is disposed over the first section 12 and the second section 14 of the ground plane 10. It is desirable to minimize or eliminate the potential differences between the conducted power in the first section 12 and the second section 14 in the lower frequency band. Preferably, a switching means 60, such as a micro-electromechanical systems (MEMS) switch, is disposed across the slot 20, such that when the antenna structure 1 is operating in the lower frequency band, the switch 60 is closed to provide electrical connection between the first section 12 and the second section 14 at a location directly under the radiating element 50. When the antenna structure is operating in the higher frequency band, the switch 60 is open, as shown in FIG. 3*b*.

Figure 3C:
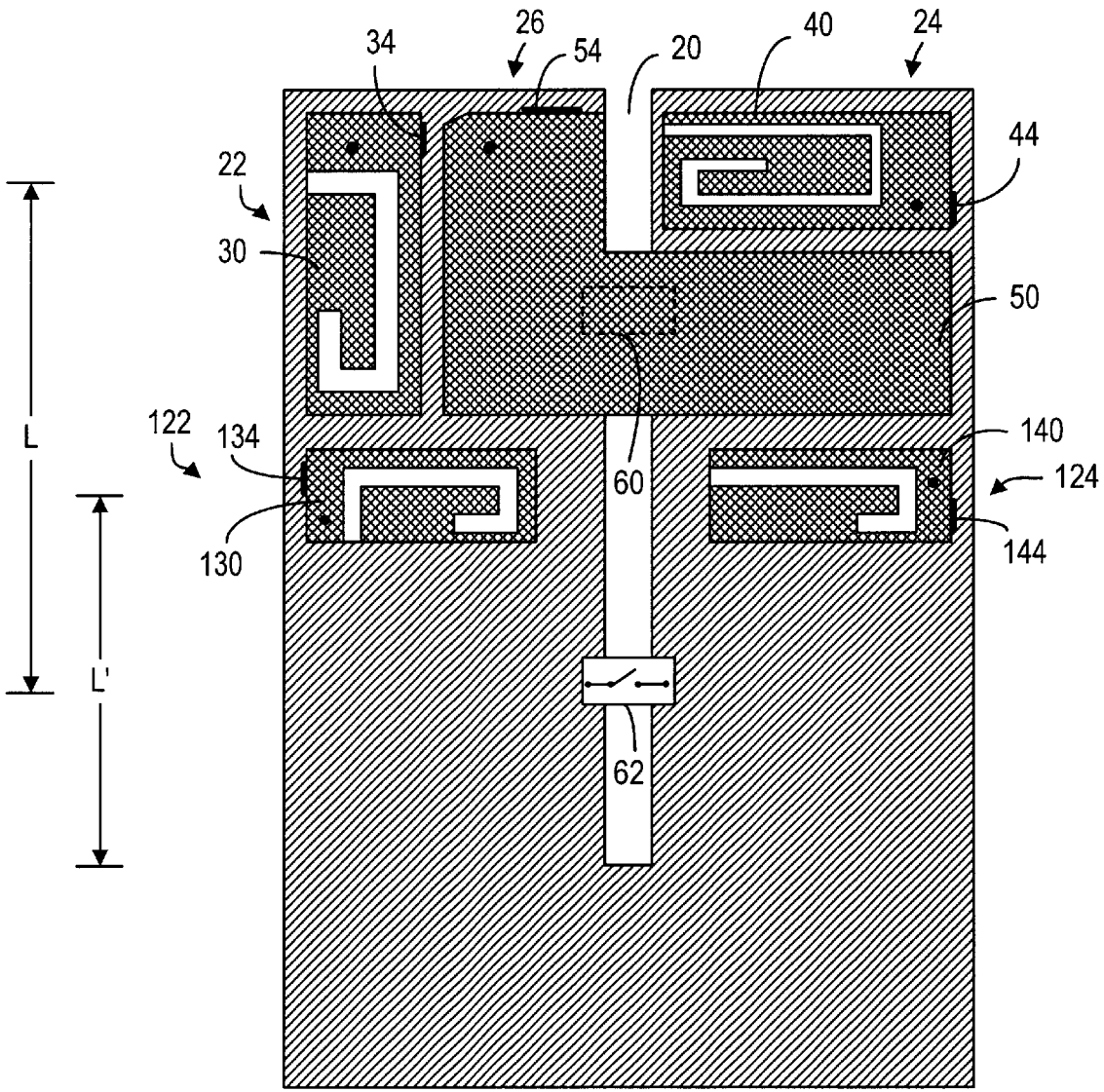
FIG. 3*c* is a schematic representation showing more antennas disposed over the ground plane.

It is possible to dispose more than one transmit/receive antenna pair sharing the same ground plane 10, as shown in FIGS. 2–3*c*. As shown in FIG. 3*c*, in addition to the first transmit/receive antenna pair 22, 24, a second transmit/receive antenna pair 122, 124 is disposed over the ground plane 10 for grounding. The second antenna pair 122, 124 comprises a receive antenna 122 having a radiating element 130 and a grounding strip 134, and a transmit antenna 124 having a radiating element 140 and a grounding strip 144. For illustration purposes, the second antenna pair 122, 124 is operating in a frequency band higher than the operating frequencies of the first antenna pair 22, 24. Thus, the wavelengths associated with the two antenna pairs are different. In order to improve the isolation in the second antenna pair 122, 124, as well as the first antenna pair 22, 24, the length of the slot 20 has to be adjusted to accommodate the different wavelengths. It is possible to dispose one or more switches over the slot 20 to adjust the effective slot length. As shown in FIG. 3*c*, a second switching means 62 is disposed over the slot 20 such that when the first antenna pair 22, 24 is used, the switching means 62 is closed (with the switching means 60 being open) so that the slot length L is. substantially equal to a quarter wavelength of the operating frequencies of the first antenna pair 22, 24. When the second antenna pair 122, 124 is used, the switching means 62 and the switching means 60 are open so that the slot length L' is substantially equal to a quarter wavelength of the operating frequencies of the second antenna pair 122, 124. When the antenna 26 is used, only the switching means 60 is required to be in the closed position.

Figure 3D:
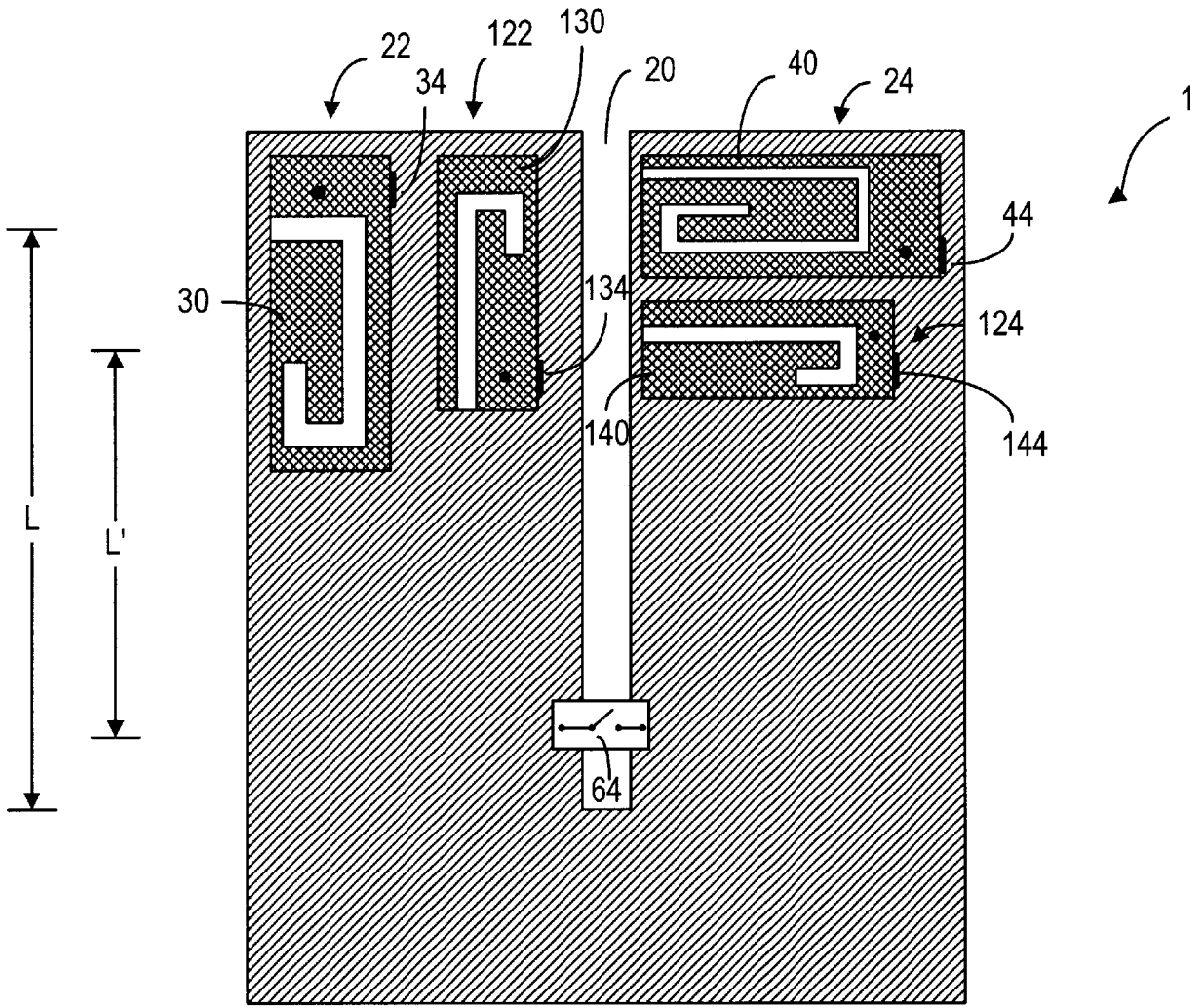
FIG. 3*d* is a schematic representation showing another embodiment of the antenna system.

FIG. 3*d* illustrates another embodiment of the present invention. As shown in FIG. 3*d*, the second antenna pair 122, 124 is also disposed near the top of the ground plane 10, along with the first antenna pair 22, 24. A switching means 64 is used to adjust the effective slot length. When the first antenna pair 22, 24 is used, the switching means 64 is open so that the slot length L is substantially equal to a quarter wavelength of the operating frequencies of the first antenna pair 22, 24. When the second antenna pair 122, 124 is used, the switching means 64 is closed so that the slot length L' is substantially equal to a quarter wavelength of the operating frequencies of the second antenna pair 122, 124.

Figure 4:
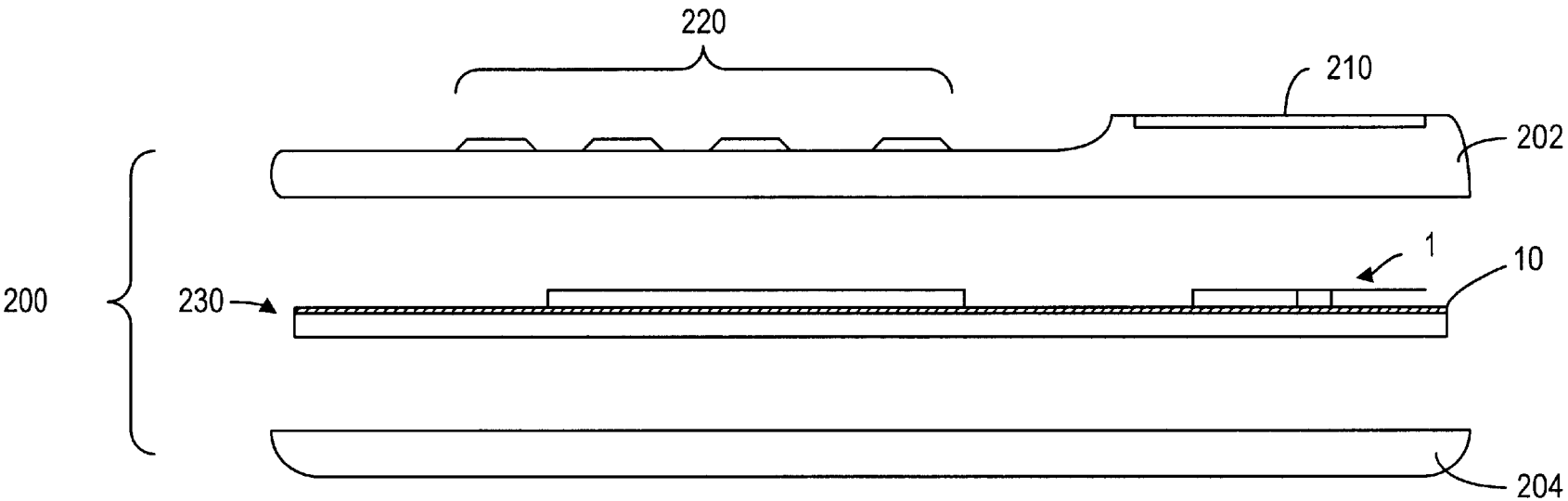
FIG. 4 is a schematic representation of a mobile phone having an improved antenna structure, according to the present invention.

FIG. 4 is a schematic representation of a multi-band mobile phone 200, according to the present invention. As shown, the mobile phone has an upper body 202 and a lower body 204 to accommodate a PWB (printed wire board) 230. As in most mobile phones, the upper body has a keypad 220 and a display 210. According to the present invention, the PWB 230 has an antenna system 1 disposed thereon. As shown in FIG. 4, the ground plane 10 of the antenna system is on the upper side of the PWB 230. Typically, there would be more than one ground plane in a mobile phone PWB. In that case, all the ground planes in the PWB must be cut to provide the slot 20, as shown in FIGS. 1–3*d*. However, the ground plane 10, according to the present invention, is the ground plane that is used to short-circuit the relevant antennas.

It should be noted that the switching means 60, 62, 64, as shown in FIGS. 3*a*–3*d*, can be a MEMS switch, FET switch or the like, so long as there is substantially no significant potential difference between the two ends of the switch.

Figure 5A:
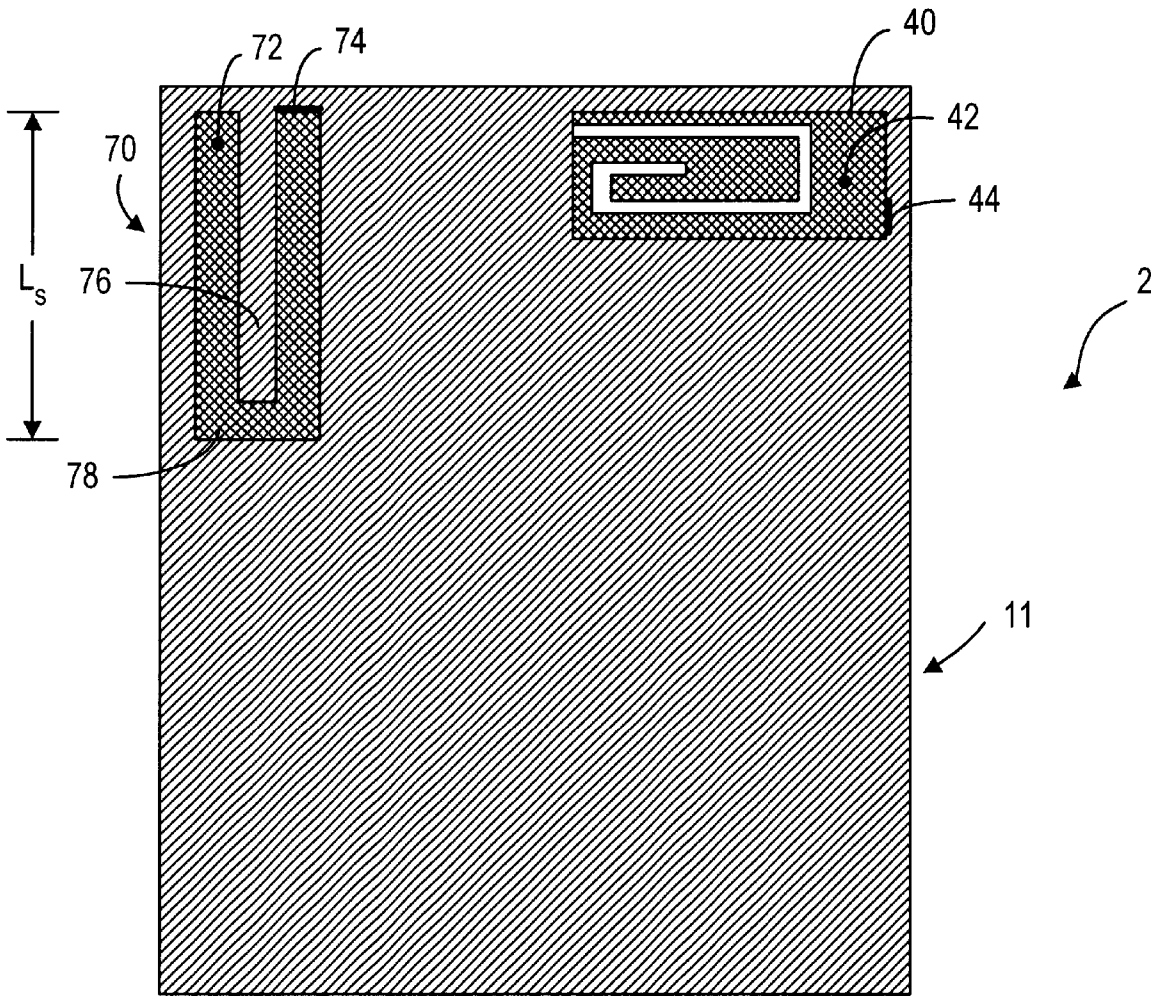
FIG. 5*a* is a schematic representation showing yet another embodiment of the antenna system having thereon two antennas.
Figure 5B:
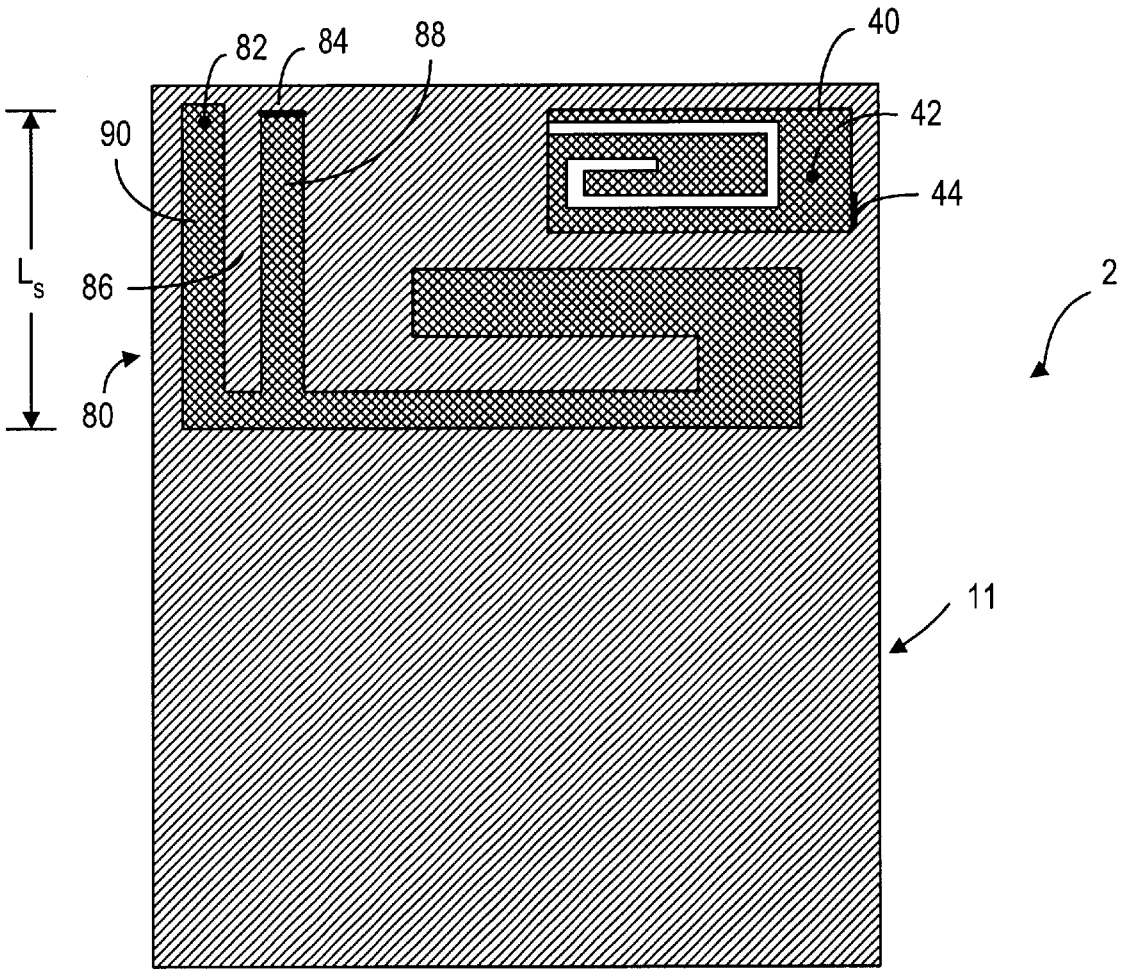
FIG. 5*b* is a schematic representation showing still another embodiment of the antenna system having thereon one single-band antenna and one dual-band antenna.

The 180-degree phase shift in the conducted and the radiated signals can be realized in a yet another embodiment of the present invention, as shown in FIG. 5*a* and 5*b*. Instead of providing a slot 20 in the ground plane, a slot antenna is used to realize the 180-degree phase shift. As shown in FIG. 5*a*, there is no slot in the ground plane 11 for phase shifting purposes. Instead of having two PIFA antennas, as shown in FIG. 2, the antenna system 2 has one PIFA antenna 40 and one slot antenna 70. The slot antenna 70 has a slot 76 in the radiating element 78. The slot 76, which separates the feed line 72 and the grounding strip 74,has a length $L_s$ substantially equal to a quarter wavelength of the resonant frequency of the radiating element 78. In effect, the feed line 72 and the grounding strip 74 is separated by a distance substantially equal to one half-wavelength of the resonant frequency. With the slot antenna 70, the signal fed to the antenna via the feed line 72 undergoes about a 180-degree phase shift before it is coupled to the ground plane 11 via the grounding strip 74. Either one of the antennas 40, 70 can be used for transmission, and the other antenna can be used for reception.

In a multi-band mobile terminal, it is possible to use one PIFA and one dual-band slot antenna. As shown in FIG. 5*b*, a dual-band slot antenna 80 is used to carry out the dual-band function. For example, if the PIFA antenna 40 is used to cover the PCS-RX Band, then the dual-band slot antenna 80 can be used to cover the PCS-TX band and another lower frequency band, such as GSM 850. As shown in the FIG. 5*b*, the radiating element for the PCS-TX band includes portions 88 and 90, which are separated by a slot 86. As such, the signal fed to the antenna via the feed line 82 undergoes about a 180-degree phase shift before it is coupled to the ground plane 11 via the grounding strip 84.

Thus, although the invention has been described with respect to a preferred embodiment thereof, it will be understood by those skilled in the art that the foregoing and various other changes, omissions and deviations in the form and detail thereof may be made without departing from the scope of this invention.

What is claimed is:

1. An antenna structure (1) comprising:

a ground plane (10) having a first section (12) and a second section (14) galvanically connected to the first section (12); and an antenna system (22, 24) operable in a frequency band and disposed over the ground plane (10), the antenna system comprising a receive antenna (22) and a transmit antenna (24), wherein the receive antenna (22) comprises a first radiating element (30) disposed over the first section (12) of the ground plane (10), and a first grounding strip (34) for grounding the first radiating element (30) to the first section (12) of the ground plane (10); and the transmit antenna (24) comprises a second radiating element (40) disposed over the second section (14) of the ground plane (10), and a second grounding strip (44) for grounding the second radiating element (40) to the second section (14) of the ground plane (10), characterized by a slot (20) provided between the first section (12) and the second section (14) of the ground plane (10) for improving isolation between the receive antenna and the transmit antenna, wherein the slot has an effective length (L) substantially equal to a quarter wavelength of the frequency band.

2. The antenna structure of claim 1, wherein the first section (12) is connected to the second section (14) by a connecting section (16) of the ground plane (10) for realizing the effective length (L).

3. The antenna structure of claim 1, further comprising a switching means (64) over the slot (20) operated in a closed position for realizing the effective length (L).

4. The antenna structure of claim 1, further comprising a transceiver antenna (26) operable in a further frequency band different from the frequency band, the transceiver antenna (26) comprising a third radiating element (50) disposed over the ground plane, straddling both the first and second sections of the ground plane, and a third grounding strip (54) for grounding the third radiating element to the ground plane, characterized by a switching means (60) disposed over the slot, wherein the switching means is operable in a closed position, for electrically connecting the first section (12) and the second section (14) when the antenna structure (1) is operating in the further frequency band, and in an open position, for keeping the first section (12) and the second section (14) electrically separated over the slot, when the antenna structure (1) is operating in the frequency band.

5. The antenna structure of claim 4, further comprising a further antenna system (122, 124) operable in a third frequency band different from the frequency band, the further antenna system comprising a further receive antenna (122) and a further transmit antenna (124), wherein the further receive antenna (122) comprises a fourth radiating element (130) disposed over the first section of the ground plane, and a fourth grounding strip (134) for grounding the fourth radiating element to first section of the ground plane; and the further transmit antenna (124) comprises a fifth radiating element (140) disposed over the second section of the ground plane, and a fifth grounding strip (144) for grounding the fifth radiating element to the second section of the ground plane, characterized in that the switching means (60) is also operating in the open position when the antenna structure is operating in the third frequency band, and further characterized by a further switching means (64) disposed over the slot, wherein the further switching means is operable in an open position for retaining the effective length (L) of the slot when the antenna structure is operating in the frequency band, and in a closed position for realizing an effective length (L') of the slot substantially equal to a quarter wavelength of the third frequency band when the antenna structure is operating in the third frequency band.

6. The antenna structure of claim 4, further comprising a further antenna system (122, 124) operable in a third frequency band different from the frequency band, the further antenna system comprising a further receive antenna (122) and a further transmit antenna (124), wherein the further receive antenna (122) comprises a fourth radiating element (130) disposed over the first section of the ground plane, and a fourth grounding strip (134) for grounding the fourth radiating element to first section of the ground plane; and the further transmit antenna (124) comprises a fifth radiating element (140) disposed over the second section of the ground plane, and a fifth grounding strip (144) for grounding the fifth radiating element to the second section of the ground plane, characterized in that the switching means (60) is also operating in the open position when the antenna structure is operating in the third frequency band, and further characterized by a further switching means (64) disposed over the slot, wherein the further switching means is operable in a closed position for retaining the effective length (L) of the slot when the antenna structure is operating in the frequency band, and in an open position for realizing an effective length (L') of the slot substantially equal to a quarter wavelength of the third frequency band when the antenna structure is operating in the third frequency band.

7. The antenna structure of claim 1, further comprising a further antenna system (122, 124) operable in a further frequency band different from the frequency band, the further antenna system (122, 124) comprising a further receive antenna (122) and a further transmit antenna (124), wherein the further receive antenna (122) comprises a third radiating element (130) disposed over the first section of the ground plane, and a third grounding strip (134) for grounding the third radiating element to the first section of the ground plane; and the further transmit antenna (124) comprises a fourth radiating element (140) disposed over the second section of the ground plane, and a fourth grounding strip (144) for grounding the fourth radiating element to the second section of the ground plane, characterized by a switching means (64) disposed over the slot, wherein the switching means is operable in an open position to retain the effective length (L) of the slot when the antenna structure is operating in the frequency band, and in a closed position to realize an effective length (L') of the slot substantially equal to a quarter wavelength of the further frequency band when the antenna structure is operating in the further frequency band.

8. The antenna structure of claim 1, further comprising a further antenna system (122, 124) operable in a further frequency band different from the frequency band, the further antenna system (122, 124) comprising a further receive antenna (122) and a further transmit antenna (124), wherein the further receive antenna (122) comprises a third radiating element (130) disposed over the first section of the ground plane, and a third grounding strip (134) for grounding the third radiating element to the first section of the ground plane; and the further transmit antenna (124) comprises a fourth radiating element (140) disposed over the second section of the ground plane, and a fourth grounding strip (144) for grounding the fourth radiating element to the second section of the ground plane, characterized by a switching means (62) disposed over the slot, wherein the switching means is operable in a closed position to retain the effective length (L) of the slot when the antenna structure is operating in the frequency band, and in an open position to realize an effective length (L') of the slot substantially equal to a quarter wavelength of the further frequency band when the antenna structure is operating in the further frequency band.

9. A method of improving isolation in an antenna structure (1), wherein the antenna structure (1) comprises:

a ground plane (10) having a first section (12) and a second section (14) galvanically connected (16) to the first section (12), and an antenna system (22, 24) operable in a frequency band disposed over the ground plane (10), the antenna system comprising a receive antenna (22) and a transmit antenna (24), wherein the receive antenna (22) comprises a first radiating element (30) disposed over the first section (12) of the ground plane (10), and a first grounding strip (34) for grounding the first radiating element (30) to the first section of the ground plane (10); and the transmit antenna (24) comprises a second radiating element (40) disposed over the second section (14) of the ground plane (10), and a second grounding strip (44) for grounding the second radiating element (40) to the second section of the ground plane (10), said method characterized by providing a slot (20) between the first section (12) and the second section (14) of the ground plane for improving isolation between the transmit antenna and the receive antenna, wherein the slot has an effective length (L) substantially equal to a quarter wavelength of the frequency band.

10. The method of claim 9, wherein the antenna structure (1) further comprises a transceiver antenna (26) operable in a further frequency band different from the frequency band, the transceiver antenna (26) comprising a third radiating element (50) disposed over the ground plane, straddling both the first and second sections of the ground plane, and a third grounding strip (54) for grounding the third radiating element to the ground plane, said method further characterized by providing a switching means (60) over the slot, wherein the switching means is operable in a closed position, for electrically connecting the first section (12) and the second section (14) when the antenna structure (1) is operating in the further frequency band, and in an open position, for keeping the first section (12) and the second section (14) electrically separated over the slot (20), when the antenna structure (1) is operating in the frequency band.

11. A mobile terminal (200) having an improved antenna structure (1) for receiving and transmitting information in a frequency band, the antenna structure (1) comprising:

a ground plane (10) having a first section (12) and a second section (14) galvanically connected (16) to the first section (12), and an antenna system (22, 24) disposed over the ground plane (10), the antenna system (22, 24) comprising a receive antenna (22) and a transmit antenna (24), wherein the receive antenna (22) comprises a first radiating element (30) disposed over the first section (12) of the ground plane (10), and a first grounding strip (34) for grounding the first radiating element (30) to the first ground plane (10); and the transmit antenna (24) comprises a second radiating element (40) disposed over the second section (14) of the ground plane (10), and a second grounding strip (44) for grounding the second radiating element (40) to the second section of the ground plane (10), characterized by a slot (20) provided between the first section (12) and the second section (14) of the ground plane (10) for improving isolation between the receive antenna and the transmit antenna, wherein the slot has an effective length (L) substantially equal to one quarter wavelength of the frequency band.

12. The mobile terminal (200) of claim 11, wherein the antenna structure (1) further comprises a transceiver antenna (26) operable in a further frequency band different from the frequency band, the transceiver antenna (26) comprising a third radiating (50) element disposed over the ground plane, straddling both the first and second sections of the ground plane, and a third grounding strip (54) for grounding the third radiating element to the ground plane, characterized by a switching means (60) disposed over the slot, wherein the switching means is operable in a closed position, for electrically connecting the first section (12) and the second section (14) when the antenna structure is operating in the further frequency band, and in an open position, for keeping the first section (12) and the second section (14) electrically separated over the slot (20), when the antenna structure is operating in the frequency band.

13. An antenna structure (2) comprising a first antenna (70, 80) and a second antenna (40), each antenna having a radiating element, a feed line and a grounding strip coupling to the radiating element to a ground plane, wherein one of the first and second antennas is used for transmission and the other is used for reception, characterized in that the radiating element (78, 88, 90) has a slot (76, 86) provided thereon for effectively separating the feed line (72, 82) and the grounding strip (74, 84) of the first antenna (70, 80) by a distance substantially equal to one half wavelength of a resonant frequency of the radiating element (78, 88, 90) of the first antenna.

14. The antenna structure of claim 13, characterized in that the slot has a length substantially equal to a quarter-wavelength of the resonant frequency.

15. The antenna structure of claim 13, characterized in that the first antenna is a slot antenna.

16. The antenna structure of claim 13, characterized in that the second antenna is a planar inverted-F antenna.

17. The antenna structure of claim 13, characterized in that the first antenna (80) is a multiple-band antenna operating in at least a first frequency band and a second frequency band different from the first frequency band, the first antenna further having a further radiating element coupled to the radiating element, and wherein the resonant frequency of the radiating element of the first antenna falls within the first frequency band, and the further radiating element has a resonant frequency within the second frequency band.

18. The antenna structure of claim 17, characterized in that the radiating element of the second antenna has a resonant frequency within the first frequency band.

19. The antenna structure of claim 18, wherein the radiating element of the first antenna is used for transmission in the first frequency band and the second antenna is used for reception in the first frequency band.

20. A method of improving isolation in antenna structure (2), wherein the antenna structure comprises a first antenna (70, 80) and a second antenna (40), each antenna having a radiating element, a feed line and a grounding strip coupling to the radiating element to a ground plane, wherein one of the first and second antennas is used for transmission and the other is used for reception, characterized by providing a slot (76, 86) on the radiating element (78, 88, 90) for effectively separating the feed line (72, 82) and the grounding strip (74, 84) of the first antenna (70, 80) by a distance substantially equal to one half wavelength of a resonant frequency of the radiating element (78, 88, 90) of the first antenna.

21. The method of claim 20, further characterized in that the slot has a length substantially equal to one quarter-wavelength of the resonant frequency.

* * * * *

UNITED STATES PATENT AND TRADEMARK OFFICE

CERTIFICATE OF CORRECTION

PATENT NO. : 6,624,789 B1
DATED : September 23, 2003
INVENTOR(S) : Kangasvieri et al.

It is certified that error appears in the above-identified patent and that said Letters Patent is hereby corrected as shown below:

Title page,
Item [57], ABSTRACT,
Line 5, after "plan" -- . -- should be inserted.

Column 7,
Line 5, "is." should be -- is --.

Signed and Sealed this

Sixth Day of January, 2004

JAMES E. ROGAN
*Director of the United States Patent and Trademark Office*